US006367183B1

(12) United States Patent
Haber

(10) Patent No.: US 6,367,183 B1
(45) Date of Patent: Apr. 9, 2002

(54) CARD ASSEMBLY FOR CARD DISPLAY UNIT

(76) Inventor: Robert Haber, 1 Sherwood Dr., Larchmont, NY (US) 10538

( * ) Notice: Subject to any disclaimer, the term of this patent is extended or adjusted under 35 U.S.C. 154(b) by 0 days.

(21) Appl. No.: 09/609,958

(22) Filed: Jul. 5, 2000

(51) Int. Cl.[7] ..... G09F 21/04

(52) U.S. Cl. ..... 40/594; 40/638; 40/606; 40/124.01

(58) Field of Search ..... 40/606, 638, 594, 40/124.01, 720

(56) References Cited

U.S. PATENT DOCUMENTS 3,971,149 A * 7/1976 Tanney ..... 40/124.1
4,643,452 A * 2/1987 Chang ..... 283/62
4,767,119 A * 8/1988 Fadner et al. ..... 40/594
4,864,755 A * 9/1989 Owens ..... 40/594
5,098,129 A * 3/1992 Haber ..... 283/62
5,221,396 A * 6/1993 Kane ..... 156/250
5,261,174 A * 11/1993 Blegen ..... 40/152
5,970,640 A * 10/1999 Farrow ..... 40/638
5,992,071 A * 11/1999 Dahlquist ..... 40/610
6,176,958 B1 * 1/2001 Shea ..... 40/615
6,217,958 B1 * 4/2001 Blyden et al. ..... 40/591

* cited by examiner

*Primary Examiner*—Robert J. Oberleitner
*Assistant Examiner*—Devon Kramer
(74) *Attorney, Agent, or Firm*—Gottlieb, Rackman & Reisman, P.C.

(57) ABSTRACT

A card assembly or system is provided. The card assembly includes a rectangularly shaped card member defined by first and third opposite edges and second and third opposite edges. The card member has an underside that is formed with an adhesive layer applied therealong. The inventive assembly also includes a rectangular backing sheet having a shape identical to that of the card member and also being adhesively secured to the adhesive layer disposed along the underside of the card member.

17 Claims, 3 Drawing Sheets

FIG. 1
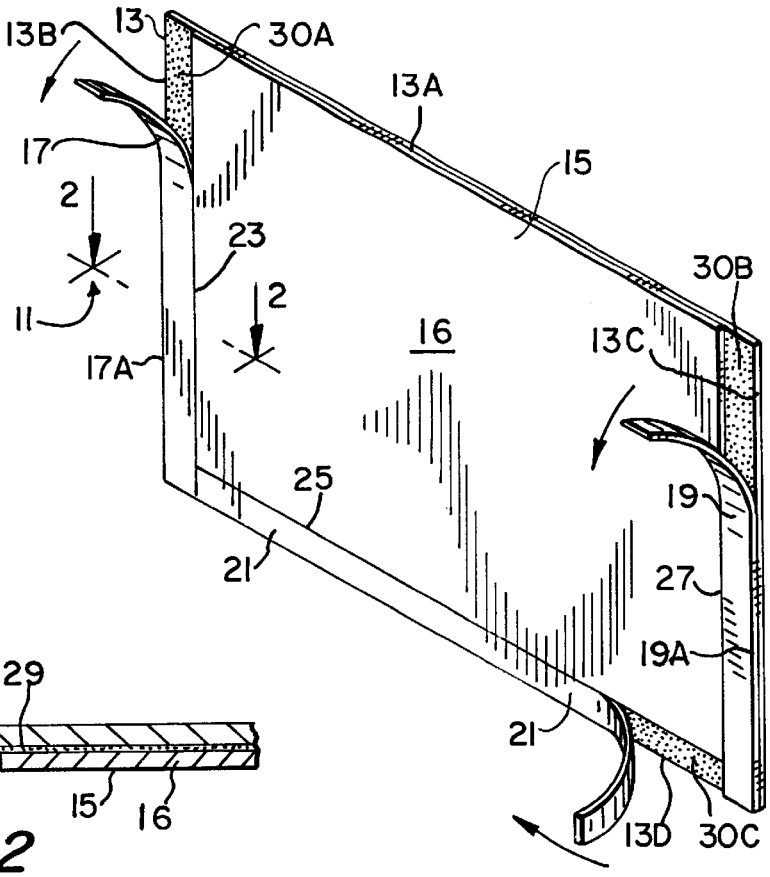
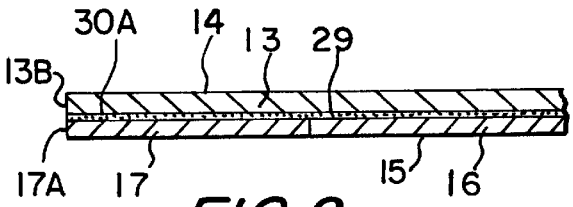
FIG. 2
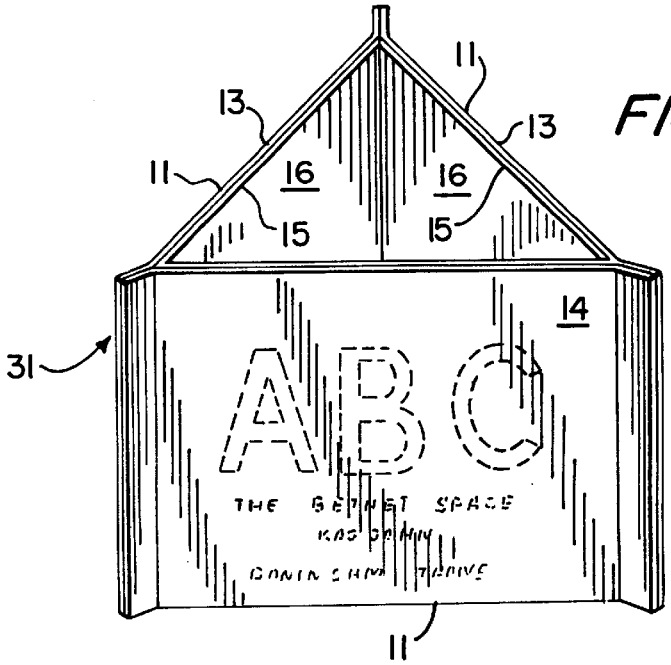
FIG. 3

11
13
13
33
15
16
16
15
5
5
15
14
14
6
6
35

13
29
13B
30A
16
16
13C
30B
29
13

29
16
13
30C
35
25

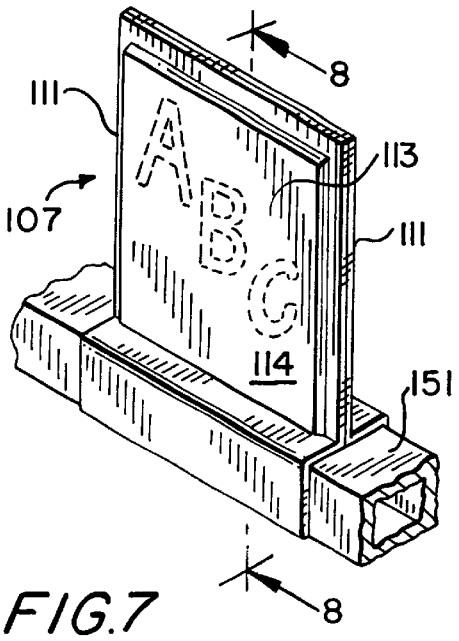
FIG.7
FIG.9
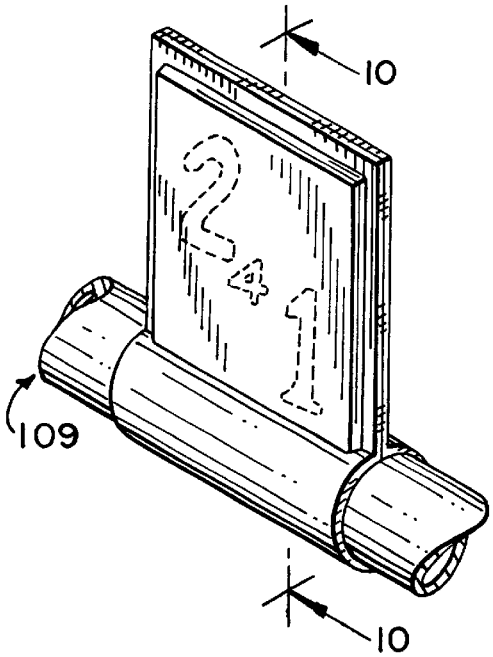
FIG.8
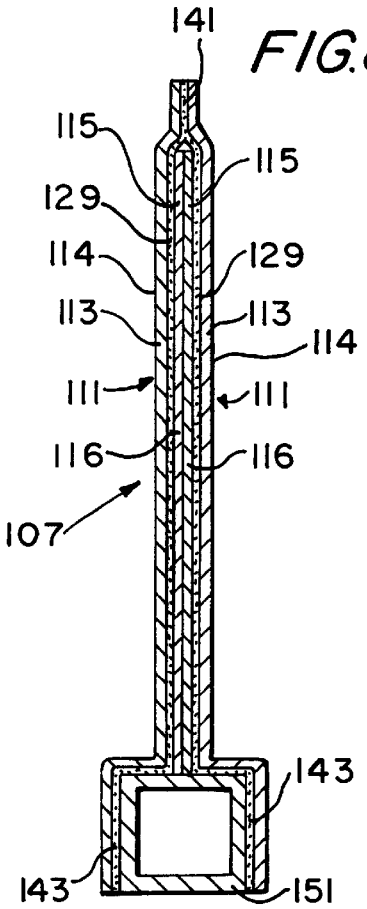
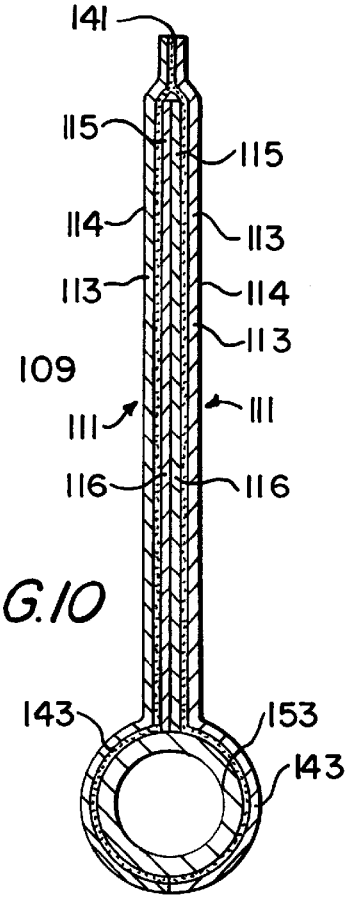
FIG.10

CARD ASSEMBLY FOR CARD DISPLAY UNIT

BACKGROUND OF THE INVENTION

This application relates to a card assembly having a self-adhesive backing, and more particularly, to a series of card assemblies which may be connected together in order to form a card display unit or system.

SUMMARY OF THE INVENTION

Generally speaking, in accordance with the invention, a card assembly or system is provided. The card assembly includes a rectangularly shaped card member defined by first and third opposite edges and second and fourth opposite edges. The card member has an underside that is formed with an adhesive layer applied therealong. The inventive assembly also includes a rectangular backing sheet having a shape identical to that of the card member and also being adhesively secured to the adhesive layer disposed along the underside of the card member.

Significantly, the backing sheet of the inventive assembly includes a main rectangular backing element and at least a pair of oppositely located side rectangular backing elements. One of said side backing elements has a first edge corresponding to the first edge of said card member, while the second side backing element has a first edge which corresponds to the third edge of the card member. Each pair of side backing elements also is defined by a second edge that is removably connected to opposite edges of the main backing element along a tear line.

In accordance with the invention, each of the side backing elements is selectively removable from the underside of said card member independently of removal of the main backing element from the card member underside. As a result, the adhesive layer along the underside of the card member is exposed only along opposite edges or sides thereof.

A plurality of card assemblies may be connected together in order to form the inventive card display unit. In particular, the exposed adhesive underside adjacent one end of one card member is adhered to the exposed adhesive underside adjacent one end of a second card member. Thus, a series of card members may be connected together at their ends in order to create a uniquely designed card display unit. Because only the side backing elements are removed from the underside of the card member, with the main rectangular backing element remaining secured to the adhesive layer of the underside of the card member, it is easy to manipulate and position multiple card members as desired, without unwanted areas of the card member being stuck to one another.

In an additional embodiment, the backing sheet of the inventive card assembly is defined by a main rectangular backing element, a pair of oppositely located side rectangular backing elements, and a bottom rectangular backing element disposed adjacent to one of the other edges of the card member. With this design, a card display unit is formed by connecting a plurality of card members which may be adhesively secured to a mounting or display surface by removing the bottom backing element from the underside of the card member and then folding the underside thereof for use in securement of the display unit of the invention to the surface.

In still a further embodiment of the invention, the backing sheet is defined by a main rectangular backing element, a first pair of oppositely located side rectangular backing elements and a pair of oppositely located top and bottom rectangular backing elements. In this design, when all of the backing elements are removed from the underside of the card member, the exposed adhesive layer defines an exposed adhesive framing surface for use as desired.

Accordingly, it is an object of the invention to provide an improved card assembly.

Another object of the invention is to provide an improved card assembly for use in forming a card display unit.

A further object of the invention is to provide an improved card display assembly suitable for use in advertising and promotion.

Still other objects and advantages of the invention will in part be obvious and will in part be apparent from the following specification.

The invention accordingly comprises a system and assembly possessing the features, properties and relation of elements which will be exemplified herein after, and the scope of the invention will be indicated in the claims.

BRIEF DESCRIPTION OF THE DRAWINGS

For a fuller understanding of the invention, reference is made to the following description, taken in connection with the accompanying drawings, in which:

FIG. 1 is a perspective view of the inventive card assembly;

FIG. 2 is a cross-sectional view taken along lines 2—2 of FIG. 1;

FIG. 3 is a front perspective view of one version of a card display unit made from a plurality of card assemblies of the invention;

FIG. 7 is a front perspective view of a card display unit made from a pair of inventive card assemblies and attached to a rectangular-shaped display bar;

FIG. 8 is a cross-sectional view taken along lines 8—3 8 of FIG. 7;

FIG. 9 is a front perspective view of another embodiment of a card display unit made from a pair of card assemblies of the invention and attached to a tubular-shaped display bar; and FIG. 10 is a cross-sectional view taken along lines 10—10 of FIG. 9.

DETAILED DESCRIPTION OF THE PREFERRED EMBODIMENT

Figure 4:
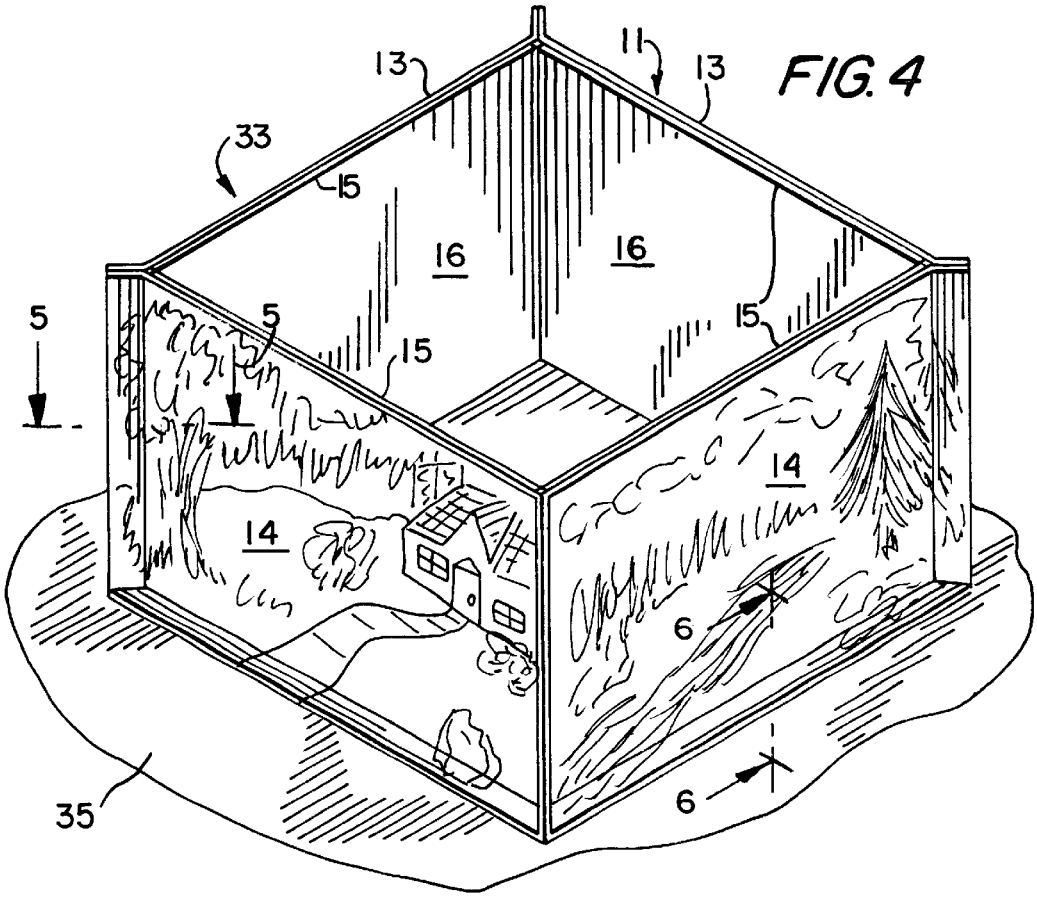
FIG. 4 is a front perspective view of a second type of card display unit which may be constructed from a plurality of card assemblies of the invention.

Referring first to FIG. 1, a card assembly made in accordance with the invention is generally indicated at 11 and is constructed utilizing pressure sensitive stock material. Card assembly 11 includes a card member 13 of a rectangular configuration and a corresponding backing sheet 15 of a rectangular configuration and essentially identical to the configuration of card member 11. Card member 11 is made of a cardboard type of material and is defined by top edge 13A, first side edge 13B, second side edge 13C and bottom edge 13D. Card member 13 has a front side 14 which may include printed material of some type (see FIG. 3) and underside having an adhesive layer 29 applied therealong (see FIG. 2).

Backing sheet 15 of card assembly 11 is adhesively mounted to the underside of card member 13 (see FIGS. 1 and 2). Backing sheet 15 is selectively die cut and peelable from card member 13 and includes a main rectangular backing element 16, a pair of oppositely disposed selectively peelable side rectangular backing elements 17 and 19, as well as a single bottom peelable backing element 21 extending between side backing elements 17 and 19 adjacent outside edge 13D of card member 13. Each of side backing elements 17 and 19 has an outside edge 17A and 19A respectively, which correspond to side edges 13B and 13C respectively of card member 13. Each of side backing elements 17 and 19 also has an inside edge 23 and 27 respectively, which define a tear or score line to enable selective separation of side backing elements 17 and 19 from main backing element 16, as described hereinafter. Similarly, bottom backing element 21 has an inside edge 25 for defining a score or tear line to enable selective separation of bottom backing element 21 from main backing element 16.

As can be appreciated, an adhesive material 29 along the undersign of card member 13 is used for selectively attaching at least a portion thereof of card member 13 to a desired surface, such as a display, document or to another card assembly of the invention (to be described). For example, any single one or selected ones of backing sheets 17, 19 and 21 may be peeled off or otherwise removed from the underside of card member 13. Moreover, any of backing elements 16, 17, 19 and 21 that are not peeled off or otherwise removed, thereby not exposing adhesive layer 29 in that area not exposed, that area of card assembly 11 may be used in a conventional fashion.

Referring now to FIG. 3, a first display unit 31 made from assemblying three of card assemblies 11 in a triangular configuration is described. Prior to assembly, side backing elements 17 and 19 of backing sheet 15 are peeled off of card member 13 while bottom backing element 21 and main backing element 16 are left intact. Thus, adhesive layer 29 adjacent edges 13B and 13C of card member 13 is exposed, thereby defining a pair of oppositely located exposed adhesive side surfaces 30A and 30B (see FIG. 1). Then, side surface 30A of one card assembly is attached to side surface 30B of a second card assembly 11 by means of the exposed adhesive material. Using three card assemblies and placing them in a triangular orientation, display unit 31 is thus constructed. Display unit 31, as shown, is designed for sitting on any suitable supporting surface.

Figure 5:
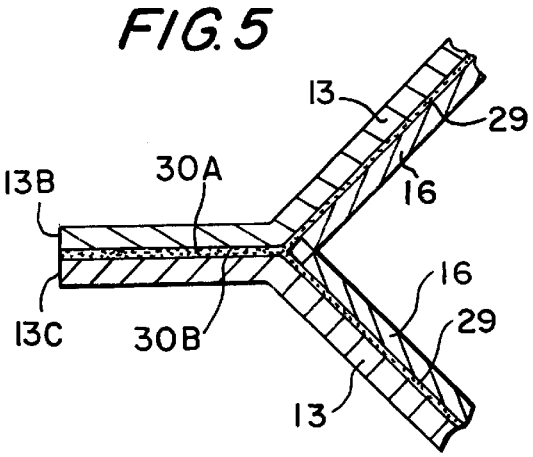
FIG. 5 is a cross-sectional view taken along lines 5—5 of FIG. 4.
Figure 6:
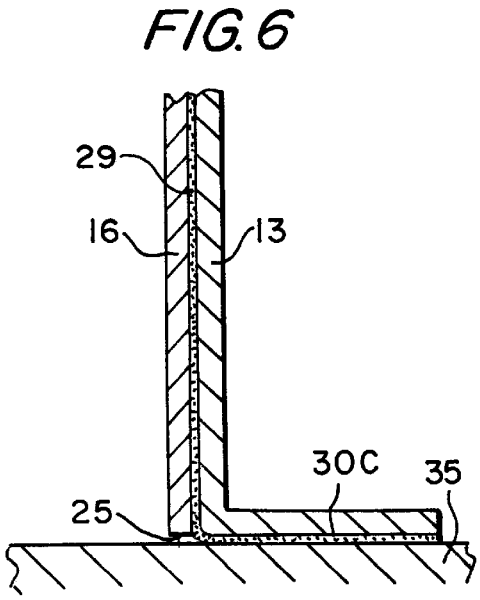
FIG. 6 is a cross-sectional view taken along lines 6—6 of FIG. 4.

Referring now to FIGS. 4–6, a second display unit, made this time from four of card assemblies 11 of the invention, is shown. Prior to construction of display unit 33, and similar to construction of display unit 31 depicted in FIG. 3, both of side backing elements 17 and 19 of each card assembly 11 are peeled off, thereby exposing adhesive side surfaces 30A and 30B. In addition, bottom backing element 21 is also peeled off from each of card members 13, thereby exposing a bottom adhesive surface 30C (see FIG. 1). As shown in FIG. 4, four card assemblies 13 of the invention are utilized, with backing elements 17, 19 and 21 peeled off from the underside of each card member 13, as described above. Then, side surface 30A of each card assembly 11 is affixed to side surface 30B of an adjacent card assembly 11 in order to define a square or rectangular-shaped display unit 33. Thereafter, bottom surfaces 30C of each of card assemblies 11 are folded up and outwardly so that surfaces 30C face downwardly toward a mounting surface 35. This enables more permanent attachment of unit 33 to surface 35, since bottom surfaces 30C of card assemblies 11 stick or otherwise adhere to surface 35, thereby preventing accidental movement or removal of unit 33 from a selected position along surface 35 on which unit 33 has been placed.

Referring now to FIGS. 7–10, a second embodiment of the inventive card assembly is generally indicated at 111. As with the embodiment depicted in FIGS. 1–2, card assembly 111 includes a rectangular-shaped card member 113 having an underside with an adhesive layer 129 therealong and a front side 114. Each of card assemblies 111 also includes a backing sheet 115 having a rectangular configuration that is essentially identical to that of card member 113. Backing sheet 115 is adhesively secured to adhesive layer 129 disposed along the underside of card member 113. Backing sheet 115 is defined by a main rectangular backing element 116 and four rectangular side backing elements which, as shown in FIGS. 7–10, have already been peeled off or otherwise removed from the underside of card member 113, thereby exposing adhesive material 129. Significantly, one of side backing elements of backing sheet 115 has a width substantially greater than the width of the remaining side backing sheet elements.

When each of the side backing elements is peeled off of card member 113, an adhesive border is defined along the underside of card 113, including a top adhesive border 141 and a wider bottom adhesive border 143, as well as a pair of side adhesive borders (not shown). In FIGS. 7–10, the corresponding top and side adhesive borders of a pair of card assemblies 111 are adhered together, and bottom adhesive borders 143 of card assemblies 111 are wrapped about a rectangular display rod 151 (FIGS. 7–8) or a tubular display rod 153 (FIGS. 9–10).

Thus, a uniquely designed display unit 107 (FIGS. 7–8) or 109 (FIGS. 9–10) is created.

Although the card member of the invention is shown in the various illustrated embodiments as being rectangular shaped, any geometric shape may be used without departing from the scope of the invention.

It will thus be seen that the objects set forth above, among those made apparent from the proceeding description, are efficiently attained and, since certain changes may be made in the construction set forth without departing from the spirit and scope of the invention, it is intended that all matter contained in the above description and shown in the accompanying drawings shall be interpreted as illustrative, and not in a limiting sense.

It is also to be understood that the following claims are intended to cover all of the generic and specific features of the invention herein described and all statements of the scope of the invention, which, as a matter of language, might be said to fall therebetween.

What is claimed:

1. A card assembly comprising:

a card member of rectangular configuration of a size defined by first and third opposite edges and second and fourth opposite edges and having an underside with an adhesive layer applied therealong;

a backing sheet of rectangular configuration essentially identical in size to that of said card member and being adhesively secured to the adhesive layer applied along the underside of said card member;

said backing sheet comprising a main rectangular backing element and a pair of side rectangular backing elements, each of said side backing elements having a first edge corresponding to said card member first and third edges respectively and a second edge removably connected to opposite edges of said main backing element along a tear line;

wherein each of said side backing elements are selectively removable from the underside of said card member independent of removing said main backing element from said card member underside;

said card element being sized and shaped to form various shapes when joined to other similar card elements with at least some of the backing elements being removed.

2. The card assembly of claim 1, wherein said side rectangular backing elements are of substantially the same size.

3. The card assembly of claim 1, wherein said backing sheet further includes a bottom edge rectangular backing element having a first edge corresponding to said card member second edge and a second edge removably connected to said main backing element along a tear line.

4. The assembly of claim 3, wherein said backing sheet further includes a top rectangular backing element having a first edge corresponding to said card member fourth edge and a second edge removably connected to said main backing element along a tear line.

5. The card assembly of claim 1, wherein one of said side rectangular backing elements has a width substantially greater than that of said other side-backing element.

6. The assembly of claim 1, wherein said card member has a front side with printed information.

7. The card assembly of claim 1 wherein said backing elements are sized and shaped to form one of a first and a second shape, wherein said first shape is formed with said main backing element being removed and said second shape is formed with only said side backing elements being removed.

8. A display unit comprising a plurality of geometrically arranged card members, each defined by first and third opposite side edges and having an underside with an adhesive layer therealong to which a backing sheet is adhesively secured, said backing sheet sized to define first and third exposed adhesive side surfaces located along said underside and between said backing sheet and said first and third edges respectively;

wherein said first adhesive surface of one of said card members is adhered to said third adhesive surface of an adjacent card member in said display unit, wherein each of said card members has a bottom side edge and the underside of each of said card members further includes a second exposed adhesive side surface located along said underside and between said backing sheet and said bottom edge.

9. The display unit of claim 8, wherein said second exposed side surface of each of said card members is folded downwardly in order to collectively define an adhesive seating surface.

10. A card for use in a display unit comprising a card member having a size and configuration defined by first and third opposite edges and having an underside with an adhesive layer at least partially applied therealong, a backing sheet disposed along said underside essentially identical in size and configuration to that of said card member and being secured to the adhesive layer along the card member underside, said backing sheet including a pair of selectively removable side backing elements disposed along said adhesive layer each defined by a first edge corresponding to the card member first and third edges respectively.

11. The card of claim 10, wherein said adhesive layer is applied over the entire underside of said card member.

12. The card of claim 11, wherein said backing sheet further includes a main backing element which separates said side backing elements.

13. The card of claim 12, wherein said side backing elements are selectively removable from the underside of said card member independent of removing said main backing element from the underside of said card member.

14. The card of claim 10, wherein the configuration of both said card member and said backing sheet is rectangular.

15. The card of claim 14, wherein said side backing elements are rectangular in configuration.

16. A card assembly comprising:

a card member of rectangular configuration of a size defined by first and third opposite edges and second and fourth opposite edges and having an underside with an adhesive layer applied therealong;

a backing sheet of rectangular configuration essentially identical in size to that of said card member and being adhesively secured to the adhesive layer applied along the underside of said card member;

said backing sheet comprising a main rectangular backing element and a pair of side rectangular backing elements, each of said side backing elements having a first edge corresponding to said card member first and third edges respectively and a second edge removably connected to opposite edges of said main backing element along a tear line;

wherein each of said side backing elements are selectively removable from the underside of said card member independent of removing said main backing element from said card member underside;

wherein one of said side rectangular backing elements has a width substantially greater than that of said other side backing element.

17. A card assembly comprising:

a card member of rectangular configuration of a size defined by first and third opposite edges and second and fourth opposite edges and having an underside with an adhesive layer applied therealong;

a backing sheet of rectangular configuration essentially identical in size to that of said card member and being adhesively secured to the adhesive layer applied along the underside of said card member;

said backing sheet comprising a main rectangular backing element and a pair of side rectangular backing elements, each of said side backing elements having a first edge corresponding to said card member first and third edges respectively and a second edge removably connected to opposite edges of said main backing element along a tear line;

wherein each of said side backing elements are selectively removable from the underside of said card member independent of removing said main backing element from said card member underside;

wherein said backing sheet further includes a bottom edge rectangular backing element having a first edge corresponding to said card member second edge and a second edge removably connected to said main backing element along a tear line.

* * * * *